United States Patent [19]

Ruetschle et al.

[11] Patent Number: 4,706,950

[45] Date of Patent: Nov. 17, 1987

[54] SHEET GATHERING APPARATUS

[75] Inventors: Rudolph H. Ruetschle, Avon Lake; Keith S. Macey, Rocky River, both of Ohio

[73] Assignee: K. S. Macey Machine Company, Inc., Cleveland, Ohio

[21] Appl. No.: 816,458

[22] Filed: Jan. 6, 1986

[51] Int. Cl.[4] ..... B65H 39/02

[52] U.S. Cl. ..... 270/54

[58] Field of Search ..... 270/54, 55, 56, 57, 270/58

[56] References Cited

U.S. PATENT DOCUMENTS

| | | | |
|---|---|---|---|
| 3,481,594 | 12/1969 | McCain et al. | 270/54 |
| 3,554,532 | 1/1971 | Cosgrove | 270/54 |
| 3,717,337 | 2/1973 | McCain et al. | 270/54 |
| 4,085,927 | 4/1978 | Muller | 270/54 |
| 4,564,186 | 1/1986 | Clarke et al. | 270/54 |

*Primary Examiner*—E. H. Eickholt

*Attorney, Agent, or Firm*—Fay, Sharpe, Beall, Fagan, Minnich & McKee

[57] ABSTRACT

An apparatus for gathering signatures including a hopper for holding a supply of signatures and a rotatable transfer drum positioned horizontally adjacent thereto for extracting a signature from the supply and carrying the signature in a first path about the periphery of the transfer drum. An adjustable stop is provided for limiting the movement of the signature along the first path to cause the signature to be stopped with its front edge portions at a predetermined location. A first spreader drum is mounted beneath the transfer drum assembly with its outer peripheral surface nearly tangential to the outer peripheral surface of the transfer drum at the predetermined location. Grippers are carried by the spreader drum for engaging the front edge portions of the signature engaged with the stop and conveying the signature away from the transfer drum along a second path. A second spreader drum is mounted along the second path adjacent the first spreader drum and is rotatable about an axis parallel to the axis of rotation to define a nip between the first spreader drum and the second spreader drum. Grippers carried by the second spreader drum function to grip a front edge portion of the signature on the side of the signature outwardly of the first spreader drum as the signature passes through the nip and pull the side thus gripped away from the side engaged with the first spreader drum to pull the signature into an inverted V-shape for deposit on a subjacent conveyor.

8 Claims, 6 Drawing Figures

SHEET GATHERING APPARATUS

BACKGROUND OF THE INVENTION

The subject invention is directed toward the art of book binding machines in general and, more particularly, to an improved apparatus for extracting and opening signatures for placement on a saddle gatherer.

Many different apparatus are used for extracting signatures from a supply thereof and depositing them on an endless conveyor which transports gathered stacks of the signatures to further processing equipment. One of the more typical types uses vacuum cups to deflect the bottom signature from a stack to a position where clamping means on a rotating extractor drum can grip the folded back edge of the signature. As the extractor drum rotates, it pulls the signature from the stack and carries it around the drum to a stop position. At the stop position, the clamping means on the extractor drum release and grippers on a spreader drum engage a cut front edge of the signature and pull it away from the extractor drum.

Rotation of the spreader drum delivers the signature to an opener drum where the cut front edge is gripped by grippers associated with the spreader drum. With the signature engaged by the grippers of both the extractor drum and the opener drum, the signature is opened to an inverted V-shape as the drums rotate in opposite directions.

As the signature completes its passage through the nip area between the spreader and opener drums, the grippers release and the signature falls to a saddle from which it is gathered together with other signatures and conveyed to a stapling or stitching machine.

The typical prior art machine is significantly more complex than described above. Generally, for example, various "dipper" or "wiper" elements must be coordinated with the movement of the drums. These elements engage the signature to support or position it for proper engagement by the grippers on the succeeding drum. In addition, because of their orientation and interrelationships, the extractor drums and the spreader drums have interengaged disk sections and differing diameters. This requires that the drums be driven at different speeds and, further, that there be different gripper designs on each drum. All of the noted factors create mechanical and structural complexities and increase the costs of the units.

SUMMARY OF THE INVENTION

The subject invention provides a highly simplified apparatus of the general type described. Because of the orientation and arrangement of the various drum means, the need for dippers and wiper members is eliminated. Additionally, the drive and coordination of the various drum members is greatly simplified, since the apparatus can have all drums driven at the same speed.

In accordance with one aspect of the invention, there is provided apparatus for gathering signatures of the type having a folded back and two front edge portions opposite the back. The apparatus includes hopper means for holding a supply of the signatures at a first location. Positioned horizontally adjacent the hopper means is a rotatable transfer drum means for extracting a signature from the supply and carrying the signature in a first path about the periphery of the transfer drum. A stop means is provided adjacent the path for limiting the movement of the signature to cause the signature to be stopped with its front edge portions at a predetermined location adjacent the transfer drum. A first spreader drum means is mounted for rotation subjacent the transfer drum means with its axis of rotation extending parallel to the axis of rotation of the transfer drum and its outer peripheral surface nearly tangential to the outer peripheral surface of the transfer drum substantially at the predetermined location. Gripper means are carried by the first spreader drum means for engaging the front edge portions of a signature engaged with the stop means and, thereafter, conveying the signature away from the stop means and the transfer drum along a second path about the periphery of the first spreader drum. Mounted along the second path adjacent the first spreader drum is a second spreader drum means. The second spreader drum means is mounted for rotation about an axis parallel to the axis of rotation of the first spreader drum in a plane generally perpendicular to the plane which includes the axes of rotation of the first spreader drum and the transfer drum. Gripper means are carried by the second spreader drum for gripping a front edge portion of a signature on the side of the signature outwardly of the first spreader drum as the signature passes through the nip between the first and the second spreader drums. The first and second spreader drums are rotated in opposite directions and, thus, the signature is pulled into an inverted V-shape as it passes through the nip.

Preferably, in accordance with another aspect of the invention, the transfer drum means and the first spreader drum means have their axes of rotation lying in a common, generally vertically extending plane. In addition, it is preferable that the transfer drum means and the spreader drum means each have their outer peripheries located at substantially the same radius from their respective axis of rotation.

With the various drum means located and oriented in the manner described, the engagement of the signature by the gripper means of the first spreader drum takes place while the front edges of the signature are supported by the outer periphery of the first spreader drum. This eliminates the need for a dipper member or separate wiper members to position the edge of the signature. Similarly, the relationship between the first spreader drum and the second spreader drum means also allows transfer and engagement of the signature to take place while the free edges are in the nip between the two drum means and generally engaged with and supported by the outer peripheries of the drums.

In accordance with a further aspect of the invention, the orientation and arrangement of the various drum means allow each of the drum means to have substantially identical gripper arrangements. That is, because all engagement and transfer of the signature is done while it is supported and engaged by the outer peripheries of the drums the gripper members can be of uniform construction.

Accordingly, a primary object of the subject invention is the provision of an apparatus of the type described which is greatly simplified relative to prior devices.

A still further object is the provision of an apparatus of the general type described wherein the drive and control arrangements for the various drum means is greatly simplified because all of the drums have a common diameter and orientation to thereby allow elimination of special controls and speed changing devices.

Yet another object is the provision of such an apparatus wherein the spreader drum means carry both vacuum and mechanical gripping devices to allow the apparatus to handle a variety of types of signatures without modifying the drum means.

BRIEF DESCRIPTION OF THE DRAWINGS

The above and other objects and advantages will become apparent from the following description when read in conjunction with the accompanying drawings wherein.

DETAILED DESCRIPTION OF A PREFERRED EMBODIMENT

Figure 1:
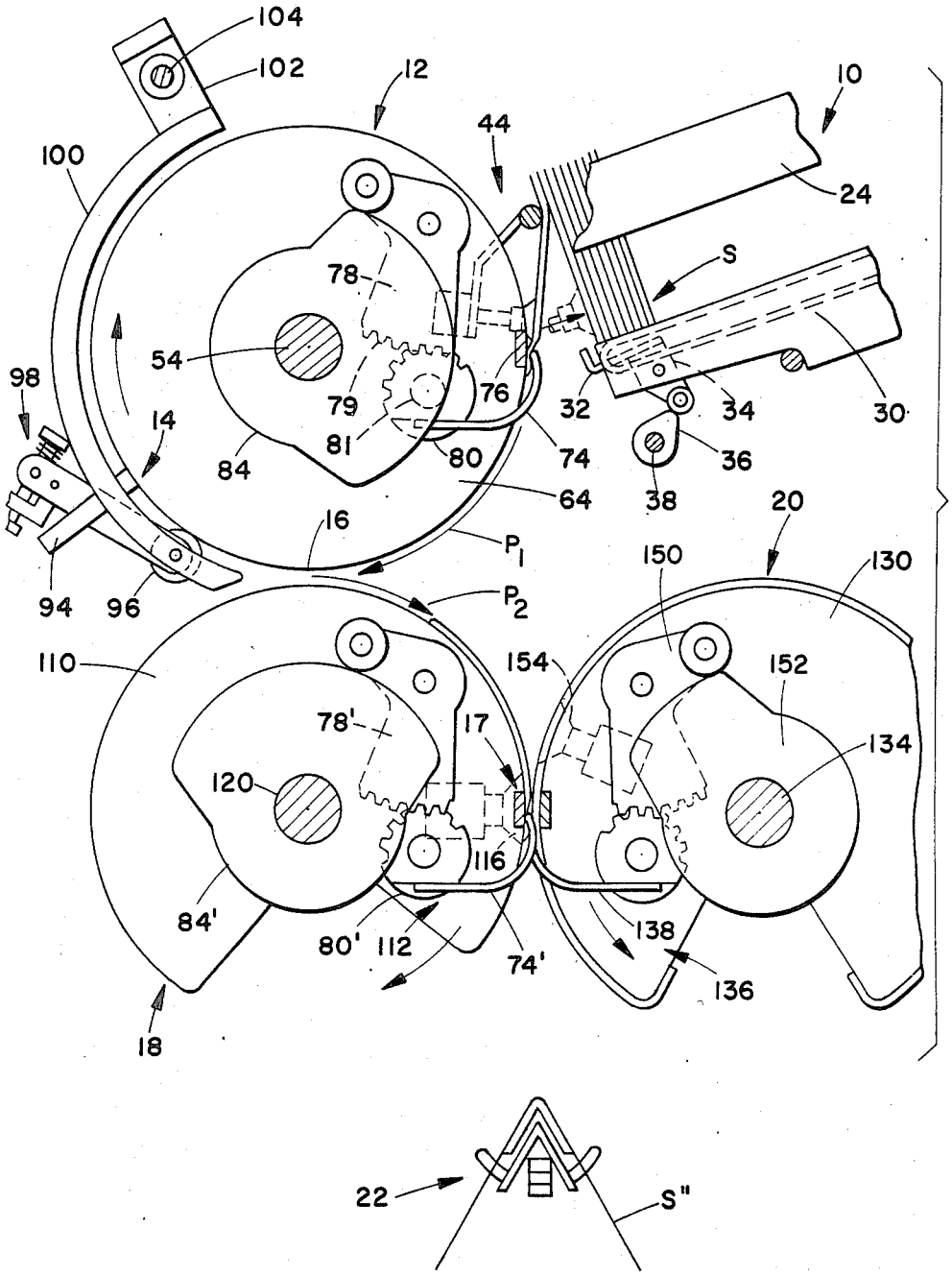
FIG. 1 is a side elevational view, in somewhat diagrammatic form, showing the overall general arrangement and construction of the various drum members.

Referring more particularly to the drawings wherein the showings are for the purpose of illustrating a preferred embodiment of the invention only, and not for the purpose of limiting same, FIG. 1 shows the general overall arrangement of the major components of the subject apparatus.

GENERAL DESCRIPTION OF THE APPARATUS

The apparatus shown is arranged to transfer individual signatures from a supply thereof and deposit them on a subjacent conveyor where they are stacked and gathered with other signatures placed on the conveyor by duplicate, serially positioned units. Consequently, it should be understood that the FIG. 1 apparatus is normally combined with four or more duplicate units serially arranged in a single machine. Specifically, as shown, the apparatus includes a hopper assembly 10 mounted at an elevated location and arranged to hold a stack or supply of signatures S in position for removal from the hopper assembly 10 in seratim order by a transfer drum means 12. In their simplest form, signatures are single sheets of paper folded in the middle so as to comprise four paper surfaces connected along a folded back edge and having a pair of front edges. It should be understood, however, that the signatures can comprise multiple sheet assemblies. In addition, the front edges of the signatures are normally offset so that one of the edges extends outwardly a greater distance than the other.

The hopper assembly 10 supports the signatures S in a generally vertical orientation with their folded back edges lowermost. The apparatus shown is arranged so that individual signatures S are removed from the hopper assembly and transferred to the transfer drum means 12 which withdraws them from the hopper assembly and conveys them in a clockwise direction (as shown in FIG. 1) along a path P1 defined by the outer periphery of the transfer drum means. The individual signatures are conveyed along path P1 until they engage a stop location defined by a stop member 14. At the stop location, the folded back edges of the individual signatures engage the stop member 14. Member 14 is preferably adjustably mounted in a manner subsequently to be described and is positioned such that the free front edges of the signatures are substantially at the tangent point 16 between the extractor drum means 12 and a subjacent first spreader drum means 18.

The first spreader drum means 18 functions to grip the front edges of the signatures while they are in location at tangent point 16 and transfer the signatures along a second path P2 away from the stop 14 and the transfer drum means 12. Path P2 is generally defined by the outer peripheral surface of the first spreader drum means 18. As shown, first spreader drum means 18 is also continuously rotated clockwise and conveys the signatures, front edges first, through a nip 17 defined by the outer periphery of the first spreader drum means 18 and the outer periphery of a second spreader drum means 20. The first spreader drum means 18 and the second spreader drum means 20 cooperate to spread the individual signatures into an inverted V-shape, as shown at S′ and deposit them individually onto a subjacent saddle and conveyor assembly 22 of conventional design.

DETAILED DESCRIPTION OF COMPONENTS AND THEIR OPERATION

Figure 6:
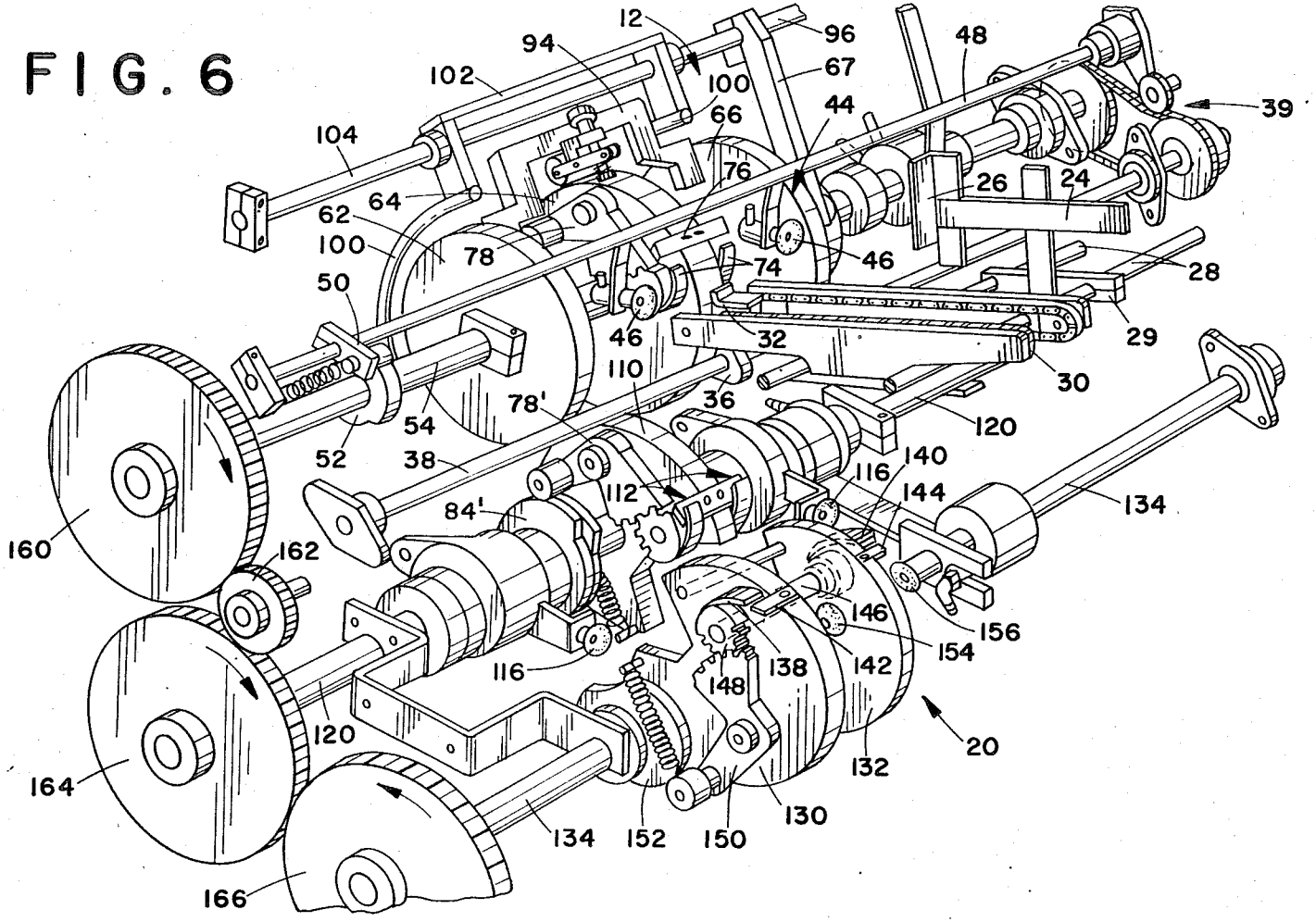

Referring specifically to FIG. 6, the components shown somewhat diagrammatically in FIG. 1 and previously described in general terms are shown in greater mechanical detail. In the FIG. 6 showing, the machine frame and housing components have been omitted for the purpose of clarity since the details of these components form no part of the invention.

Returning again to the upper or inlet end of the apparatus, the hopper assembly 10 is relatively conventional for this type of apparatus and comprises a pair of side frame members or guide means 24 including inwardly directed end plates 26. Only one of the side frame members is shown in FIG. 6; however, it should be understood that a second is located on the opposite side of conveyor 30. The guide members engage the opposite ends of the stack of signatures and keep them aligned on conveyor 30. The side frames 24 are mounted for longitudinal adjustment on a spaced pair of support bars 28 by sliding clamp bars 29.

As mentioned, the side frames 24 are positioned on opposite sides of the intermittently operated chain-type conveyor assembly 30 which has a slight downward inclination toward transfer drum means 12, as shown in FIGS. 1 and 6. Signatures positioned, as shown in FIG. 1, are continually moved toward the end plates 26 by the conveyor 30.

Associated with the conveyor 30 is an oscillated stop finger member 32 which engages the lower folded back edge of the leftmost signature (as viewed in FIG. 1) and holds it in position until it is to be removed for transfer to the transfer drum means 12. The oscillated finger 32 is carried by a pivotally mounted bracket 34 which is oscillated in timed relationship with the movement of the transfer drum means by a cam 36 (see FIG. 6) carried on rotatably driven shaft 38. Shaft 38 is directly driven in timed relationship with the movement of the transfer drum means 12 through a chain drive 39.

Figure 2:
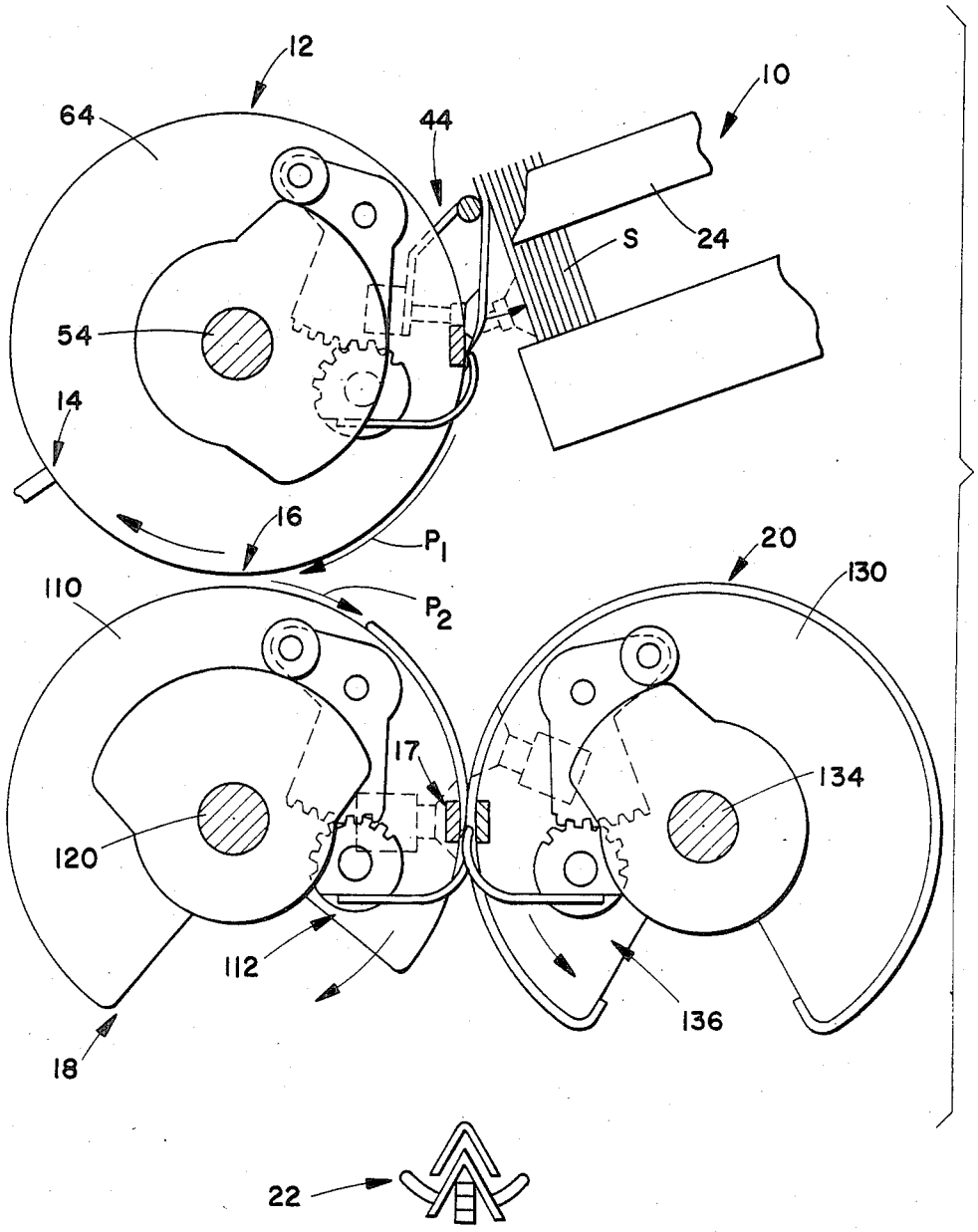
FIGS. 2–5 are somewhat schematic showings of the sequence of operations as the signature moves through the apparatus; and, FIG. 6 is a pictorial view showing the various drum members and their drive and control means.

Associated with the hopper assembly 10 and mounted adjacent the transfer drum means 12 is a vacuum cup assembly 44 which is arranged to engage the folded lower end of the leftmost signature (see FIG. 1) and retract it toward the transfer drum means 12 in timed relationship with the movement of the drum means and the oscillation of the stop finger 32. As best shown in FIG. 6, the vacuum cup assembly 44 comprises a pair of vacuum cup member 46 each suitably carried by arms depending from a horizontally extending shaft 48. Oscillatory movement is imparted to shaft 48 by a cam follower 50 carried on an arm attached to shaft 48 and biased into engagement with a rotary cam member 52. As shown, the rotary cam member 52 is, in the subject embodiment, carried on the main drive shaft 54 which supports the transfer drum means 12. As can be understood, the vacuum cup members are oscillated into engagement with the exposed face of the leftmost signature S at a location closely adjacent the folded edge. The clockwise rotation of the cups 46 causes the folded back edge of the leftmost signature to be deflected outwardly to a position as generally depicted in FIGS. 1 and 2. This places the signature in position for engagement and withdrawal from the hopper assembly 10 by the transfer drum means 12.

Referring again to FIG. 6, the transfer drum means 12 generally comprises three circular, disk-like members 62, 64 and 66 mounted on previously mentioned shaft 54. Members 62 and 64 are fixed to shaft 54 for rotation therewith. Member 66 is, however, rotatably supported on shaft 54 but is adjustably fixed against rotation by a bar 67 connected between it and shaft 96. For reasons which will subsequently become apparent, the arcuate position of member 66 can be adjusted by repositioning the connection point between it and bar 67.

The outer peripheries of the disks 62, 64 and 66 lie on equal radii from the axis of rotation of shaft 54 and define the previously mentioned path P1. The center disk 64 of the transfer drum means 12 is provided with a pair of mechanical gripper members 72 of relatively conventional design mounted on opposite sides of disk 64. The gripper members include resilient finger or gripper end portions 74 each adapted to clampingly engage a transversely extending member 76 carried on the outer periphery of disk 64 (see FIG. 1). The gripper members 72 are simultaneously moved between their open and closed positions by a crank arm 78 pivotally supported on disk 64 and having a sector gear portion 79. The sector gear portion 79 is drivingly engaged with a gear 80 carried at the end of a rotatable shaft 81 extending through disk 66 and carrying fingers 74. The movement of crank arm 78 and the fingers 74 is controlled, as shown, from a cam 84 which is supported on shaft 54.

Figure 3:
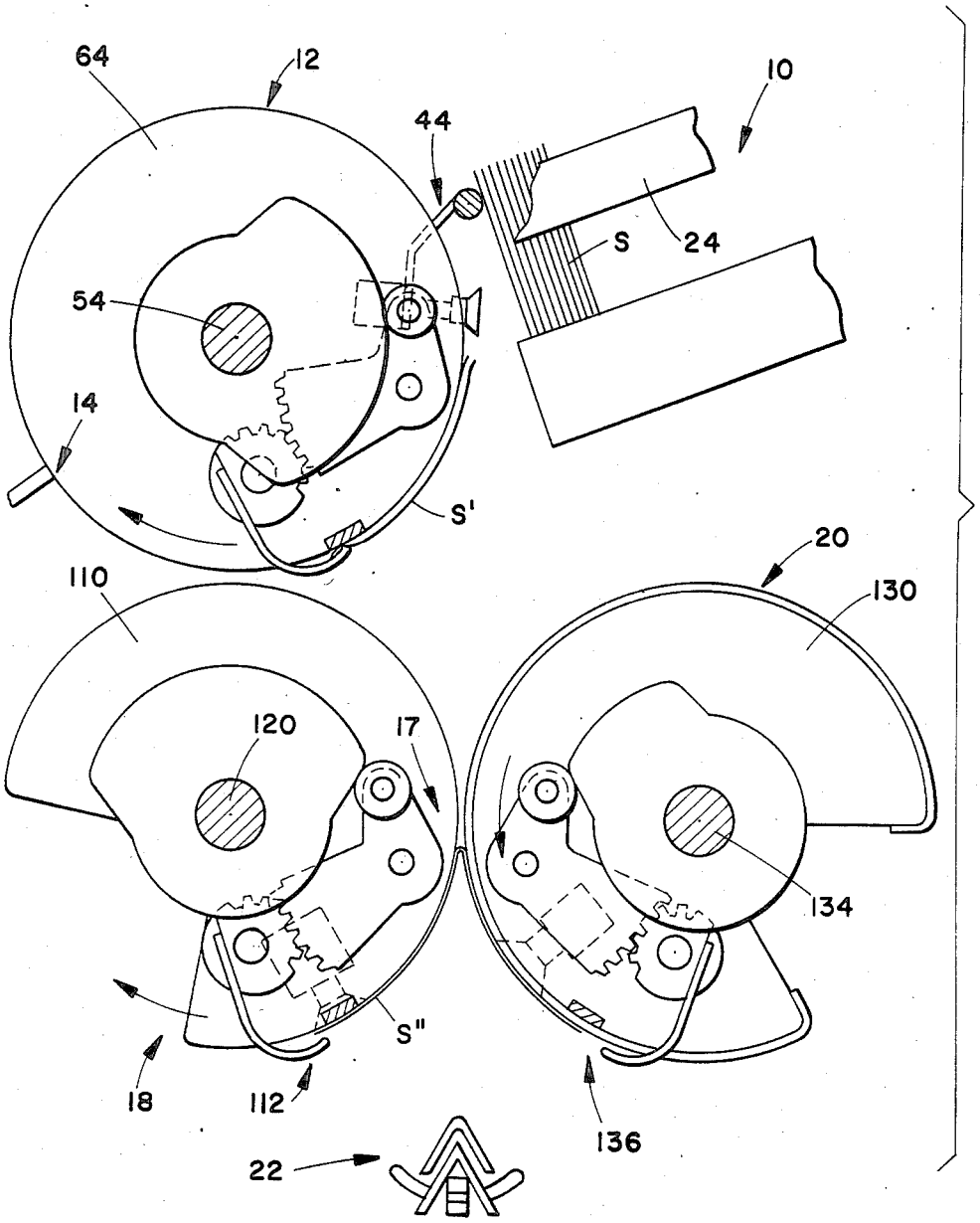
Figure 4:
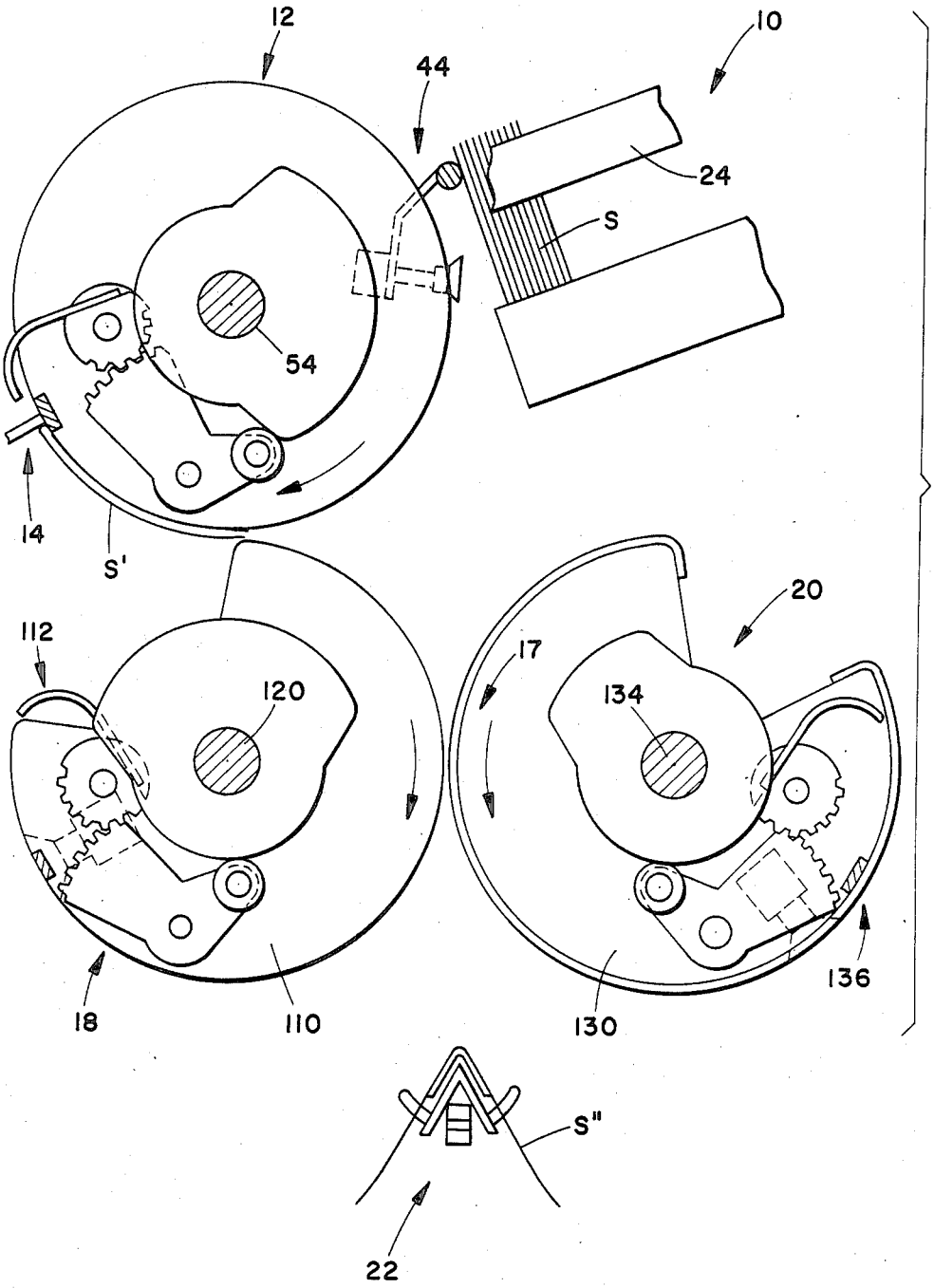

The operation of the apparatus thus far described can best be understood by reference to FIGS. 2 through 4. In particular, the vacuum cup members 46 oscillate counterclockwise into engagement with the lower edge of the leftmost signature in the hopper assembly 10 and are thereafter oscillated clockwise to deflect the leftmost signature S to the position shown in FIG. 2. As the transfer drum means 12 rotates through the position shown in FIG. 2, the clamp means 72 are actuated to cause the fingers 74 to grip the midsection of the folded back edge of the signature to the member 76. The lateral portions of the signature are, of course, engaged and supported by the peripheries of disks 62 and 66. Continued rotation of the disks 62 and 64 in a clockwise direction withdraws the signature from hopper assembly 10 and conveys it along path P1 (as shown in FIG. 3) until engagement is made with stop member 14. The transfer drum gripping means are simultaneously actuated to release the folded rear of the signature as engagement is made with stop means 14 (as shown in FIG. 4).

In the subject embodiment, the stop means 14 includes a bracket member 94 which is connected at one end to disk 66 (see FIG. 6). Member 94 extends over disk 64 to a point between disk 64 and disk 62. Member 94 thus defines the stop position on path P1.

Depending upon the size of the signature, the stop member 94 is adjusted to a position such that the front edge of the signature is at point 16 when the back edge engages the stop. Because the drum means 12 and 18 are rotated at constant and uniform velocities, the arrival of the front edge of the signature at the point 16 coincides with the movement of drum means 18 only for the maximum size of signature which the apparatus is capable of handling. For smaller signatures, the signature must momentarily remain in position at the stop until drum means 18 rotates into position for engaging the front edges at point 16.

To hold the signature in position during the noted interval, a roller 96 is carried from the mid-section of member 94. As best seen in FIG. 1, the roller 96 is maintained under a bias toward disk 64 by a spring and bracket assembly 98. Thus, when the grippers on transfer drum means 12 release, the signature is frictionally held in position against the surface of disk 64 by roller 96. Drum means 12 and its disk 64 continues rotating and slides past the signature so held.

Positioning and locating of the signature at the stop position is further assisted by a pair of arcuately shaped guide members 100 associated with path P1. The guide members 100 are supported generally in alignment with disks 62 and 66 by a bracket 102 carried on a horizontally extending bar 104. Thus, when the signature engages the stop 14 with its cut front edges substantially at tangent point 16, the guide members 100 act to provide additional support and guidance for the signature following its release by the transfer drum gripping means. Also, the peripheral surface of the first spreader drum means 18 is located nearly tangential to the drum means 12 and tends to further support the front edges of the signature.

As previously mentioned, the first spreader drum means 18 is preferably positioned directly beneath the transfer drum means 12 with its axis of rotation 106 vertically aligned with and parallel to the axis of rotation of the transfer drum means 12. The preferred construction for the first spreader drum means 18 can best be understood by reference to FIGS. 1 and 6. Specifically, the first spreader drum means 18 includes a main disk member 110 which is generally vertically aligned with disk 64 of the transfer drum means 12. The disk 110 carries a pair of mechanical clamp means 112 which are substantially identical to the previously mentioned clamp means 72. In addition, they are operated in the same manner using a cam operated crank arrangement, as shown in FIG. 6. Accordingly, the components of mechanical clamp means 112 have been identified with the same reference numerals differentiated from those of the transfer drum means by the addition of a prime (') suffix.

Associated with disk 110 and located at laterally opposite sides generally in alignment with disks 62, 66 of the transfer drum means are a pair of vacuum cup grippers 116. Vacuum cups 116 are arranged to rotate simultaneously with disk 110 on the horizontally extending shaft 120.

Referring again to FIG. 1, the operation of the first spreader drum means can be more fully understood. Specifically, with the signature in engagement with the stop member 14 its outer free edge is, as previously mentioned, located between the transfer drum means and the first spreader drum means. As discussed earlier, the relationship between the first spreader drum means 18 and the transfer drum means 12 is such that the first spreader drum means 18 supports the front edges of the signature for engagement by its gripper means. As the first spreader drum means rotates clockwise past the tangent point 16, the gripper means 112 and/or the vacuum cups 116 are actuated to engage the signature closely adjacent the free edge. Upon such engagement, and with continued rotation of the first spreader drum means 18, the signature is withdrawn from the stop 14 and the transfer drum means 12 and conveyed along path P2. When the free edge portions of the signature enter the nip 17 between the first spreader drum means 18 and the second spreader drum means 20, the second spreader drum means functions to engage the outer side of the signature and withdraw that side away from the first transfer drum means 18 to cause the signature S1 to assume the inverted V-shape configuration shown in FIG. 3.

The preferred construction and arrangement of the second spreader drum means 20 can best be understood by reference to FIG. 6. Specifically, as shown therein, the second spreader drum means 20 comprises a pair of spaced disk members 130 and 132 which are mounted for rotation on a horizontally extending shaft 134. Shaft 134 extends parallel to shaft 120 and preferably lies in a plane which is perpendicular to the plane containing the axes of rotation of the transfer drum means 12 and the first spreader drum means 18. The disks 132 and 134 are located to be on generally axially opposite sides of disk 110 of the first spreader drum means 18. Associated with the disks 130 and 132 are mechanical gripping means 136. The construction of gripping means 136 is generally the same as the construction of the previously discussed mechanical gripping means 112 and 72, except that it is basically a mirror image thereof. Specifically, as best shown in FIG. 6, the clamping means 134 includes a pair of resilient clamp fingers 138 and 140 adapted to cooperate with a correspondingly located respective clamp surfaces 142 and 144 carried by the disks 130, 132. The fingers 138 and 140 are carried from a shaft 146 which is rotatably mounted in disks 130 and 132. A sector gear 148 carried on the left end of shaft 146 is engaged with a crank arm 150 carried on disk 130 and oscillated in timed relationship with rotation of drum means 20. As shown, oscillation of crank arm 150 is controlled by a cam 152 which is mounted on shaft 134 but does not rotate therewith.

Also associated with the disks 130 and 132 are a pair of vacuum cup members 154 and 156 mounted for rotation with the disks 130 and 132. As best shown in FIG. 2, the vacuum cups 154, 156 are positioned slightly behind the mechanical gripping means 136.

As discussed earlier, the drum means 12, 18 and 20 all have the same effective outer peripheral diameter and are all rotated at the same velocity. In addition, the drums 12 and 18 are driven in the same direction and drum 20 is driven in a direction opposite thereto. Many different types of drive means and controls could be provided to achieve these ends. The preferred and simplest form for the drive means is, however, as shown in FIG. 6. As illustrated therein, shaft 54 is suitably driven from a motor (not shown) and carries a gear 160. Gear 160 is drivingly connected through an idler gear 162 with a gear 164 carried on shaft 120. Gears 160 and 164 are the same diameter and, thus, shafts 54 and 120 rotate in the same direction and at the same velocity. Likewise, shaft 134 is driven by a gear 166 of the same diameter as gear 164 and engaged therewith.

Because of the orientation of the various transfer and extractor drum means, as well as, because of their size and drive relationships, the transfer of signatures from the supply means 10 to the conveyor assembly 22 takes place with the signatures totally under control and in substantially continuous engagement with the outer periphery of the drum means. In addition, because of the arrangement of the spreader drum means 18 and 20, both mechanical gripping means and vacuum cup gripping means can be used for transferring and spreading the signatures. This greatly increases the range of types of signatures that can be handled by the apparatus. For example, either the mechanical or vacuum cup gripping means can be used alternatively or simultaneously or in selected combinations, depending upon the type of paper and/or configuration of the signatures.

As previously mentioned, FIGS. 2–5 depict in somewhat diagrammatic form the typical sequence of operations of the described apparatus. FIG. 2 shows the apparatus at the start of a pick-up cycle. It should be appreciated that the stop member 14 has been adjusted to a position such that when the back folded edge of the signature engages the stop the free or cut front edges are at an aligned position with the tangent point 16 between the transfer drum means 12 and the first spreader drum means 18. Adjustment of the stop means is accomplished by releasing the connecting bar 67 and rotating the disk 66 to bring the bracket member 94 to the desired stop position. Thereafter, the connecting bar 67 is reconnected to disk 66.

Figure 5:
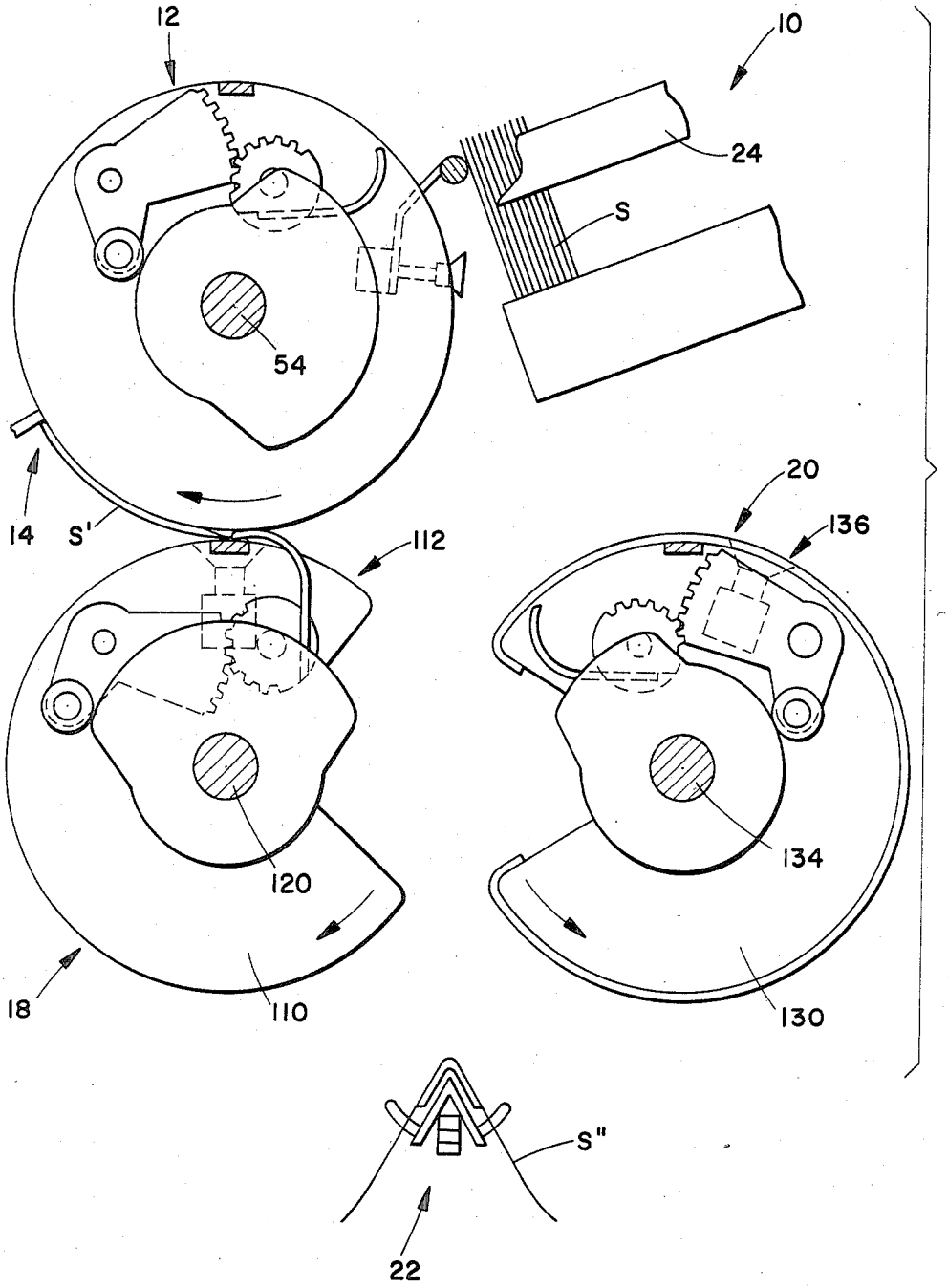

As the drum 12 rotates past the position shown in FIG. 2, the clamp means are actuated engaging and gripping the lower back edge of the signature S which has been swung outwardly by the extractor means 44. With continued rotation in the clockwise direction, as shown in FIG. 3, the signature is conveyed along path P1 into engagement with stop 14. Simultaneously with engagement with stop 14 the mechanical gripping means release and the signature S is held in position relative to the drum means 12 by the previously mentioned friction roller 98 and the curved guide members 100 (see FIGS. 1 and 6). Since the drum means are all driven at a simultaneous speed, the period of time during which the signature S′ remains against the stop depends upon the size of the signature. For example, with the maximum size signature the spreader drum 18 is in position to engage the free edge substantially simultaneously or only shortly after the signature is in position; however, with the shorter or smaller signatures the drum 18 and its mechanical clamping means 112 reach the tangent point 16 only after the signature S′ has been in position momentarily. This condition is shown in FIG. 4. Note that signature S′ has just been brought into position against stop 14 and drum 18 has an additional 90° of rotation to bring it into gripping position. FIG. 5 shows the spreader drum 18 as it passes the gripping point and the gripping means have been actuated to engage the free edge of the signature S′.

Referring again to FIG. 2, the continued rotation of drum 18 transfers the signature, cut edge first, into the bite 17 between spreader drum 18 and the second spreader drum 20. During this same time interval, the transfer drum means 12 has moved to the position where it can extract another signature from the supply means 10. As the signature S′ is moved into the bite 17 the second spreader drum means 20 is in position for engaging the vacuum cup gripping means depending upon the arrangement and/or type of signature being transferred.

With continued rotation of spreader drum means 18 and 20 the signature, now indicated with the reference letter S', is spread to the position shown in FIG. 3 and the gripping means released permitting the signature to drop to the subjacent conveyor for association with other signatures which have been previously placed on the conveyor by associated apparatus.

As can be seen from the foregoing, the subject invention provides a highly simplified apparatus which can perform signature gathering functions efficiently and rapidly without the need for special controls or the like.

The invention has been described in great detail sufficient to enable one of ordinary skill in the art to make and use the same. Obviously, modifications and alterations of the preferred embodiment will occur to others upon a reading and understanding of the subject specification. Accordingly, it is our intention to include all such modifications and alterations as part of our invention insofar as they come within the scope of appended claims.

Having thus described the invention, it is now claimed:

1. An apparatus for gathering signatures of the type having a folded back and two front edge portions opposite the back, comprising:

(a) hopper means for holding a supply signatures at a first location;

(b) rotatable transfer drum means positioned horizontally adjacent said location for extracting a signature from said supply of signatures and carrying the signature in a first path about the periphery of said transfer drum means;

(c) a stop means for limiting the movement of the signature along said first path to cause the signature to be stopped with its front edge portions at a predetermined location subjacent the transfer drum means;

(d) a first spreader drum means mounted for rotation subjacent said transfer drum means with its axis of rotation extending parallel to the axis of rotation of said transfer drum means and its outer peripheral surface nearly tangential to the outer peripheral surface of said transfer drum means substantially at said predetermined location;

(e) gripper means carried by said spreader drum means for engaging the front edge portions of a signature engaged with said stop means and conveying said signature away from said stop means and said transfer drum means along a second path about the periphery of said first spreader drum means;

(f) a second spreader drum means having an outer diameter substantially equal to the outer peripheral diameter of said first spreader drum means and mounted along said second path adjacent said first spreader drum means and rotatable about an axis parallel to the axis of rotation of said first spreader drum means in a plane generally perpendicular to the plane which includes the axes of rotation of said transfer drum means and said first spreader drum means to define a nip between said first spreader drum means and said second spreader drum means;

(g) gripper means carried by said second spreader drum means for gripping a front edge portion of a signature on the side of said signature outwardly of said first spreader drum means as said signature passes through said nip and pulling the side thus gripped away from the side engaged with said first spreader drum means; and, (h) said outer peripheral surfaces of said transfer drum means and said first spreader drum means are each located at generally the same radial distance from their respective axis of rotation.

2. The apparatus of claim 1 wherein said transfer drum means and said first spreader drum means are positioned with their axes of rotation lying in a common generally vertically extending plane.

3. The apparatus of claim 1 including drive means for rotating said transfer drum means and said first spreader drum means in the same direction and at the same peripheral speed.

4. The apparatus of claim 1 wherein said hopper means holds the signatures in a generally vertically oriented position with their folded backs lowermost.

5. The apparatus of claim 3 wherein said drive means includes means for rotating said second spreader drum means in a direction opposite the direction of rotation of said first spreader drum means.

6. The apparatus of claim 1 wherein said gripping means carried by said transfer drum means are located in planes axially spaced from the gripping means carried by said spreader drum means.

7. The apparatus as defined in claim 1 wherein said transfer drum means is formed by a pair of disk members which are rotatable in planes located on axially opposite ends of said first spreader drum means.

8. The apparatus as defined in claim 1 wherein said gripping means carried by said first and second spreader drum means comprise selectively actuable mechanical gripping means and vacuum gripping means.

* * * * *